United States Patent [19]

Jones et al.

[11] Patent Number: 4,630,868

[45] Date of Patent: Dec. 23, 1986

[54] PROCESS FOR SOLUTION MINING

[75] Inventors: Arfon H. Jones; Sidney J. Green, both of Salt Lake City, Utah

[73] Assignee: Terra Tek, Inc., Salt Lake City, Utah

[21] Appl. No.: 225,847

[22] Filed: Jan. 16, 1981

Related U.S. Application Data

[63] Continuation-in-part of Ser. No. 38,311, May 11, 1979, abandoned.

[51] Int. Cl.[3] ..... E21B 43/26

[52] U.S. Cl. ..... 299/4; 166/250; 166/308

[58] Field of Search ..... 299/4, 5; 166/250, 271, 166/245, 308

[56] References Cited

U.S. PATENT DOCUMENTS

| | | | |
|---|---|---|---|
| 3,637,261 | 1/1972 | Porter | 299/5 |
| 3,810,510 | 5/1974 | Fitch | 166/271 |
| 3,896,879 | 7/1975 | Sareen | 166/308 |
| 3,917,345 | 11/1975 | Davidson | 299/5 |
| 4,005,750 | 2/1977 | Shuck | 166/308 |
| 4,044,828 | 8/1977 | Jones | 166/250 |
| 4,082,359 | 4/1978 | Spence | 299/4 |

OTHER PUBLICATIONS

*Petroleum Reservoir Engineering,* James Amyx, et al., McGraw Hill, 1960, p. 78.

*Primary Examiner*—William F. Pate, III
*Attorney, Agent, or Firm*—M. Reid Russell

[57] ABSTRACT

The present invention embodies an improved method for the in situ mining of low to impermeable minerals to sweep out sections of deposits beneath the surface of the earth. Practicing the method of the invention generally involves: locating, by exploration at depth, a mineral deposit suitable for in situ mining and drilling a well bore into that deposit; hydraulically fracturing that well bore utilizing a disintegrating solution to break up aggregate bonding, fully opening the formation, and, at the time of fracturing, by ground surface stress changes determining the principal fracture direction; from the determined fracture direction, locating at least one production well bore appropriately alongside the first well bore and fracturing that production well bore using a disintegrating solution, which solution, optionally, includes proppants therein; passing a leaching solution flow between the well bore and production well bore to dissolve appropriate minerals from the deposit; and drawing out, preferably through the production well bore, the pregnant leaching solution for further refining above ground.

8 Claims, 5 Drawing Figures

PROCESS FOR SOLUTION MINING

This application is a continuation-in-part of Ser. No. 38,311, filed May 11, 1979, now abandoned.

BRIEF DESCRIPTION OF THE INVENTION

Field of the Invention

This invention relates to improved methods and techniques for solution mining of in situ low to impermeable mineral deposits.

BACKGROUND OF THE INVENTION

As accessible deposits of minerals near the earth's surface become ever scarcer, the need to undertake mining of deep subsurface mineral deposits will become more important. Where, at present, development of subsurface mineral deposits has generally required expensive tunneling or stripping operations to bring man and his tools into physical proximity to such deposits, in the future that mining approach may not be practical, particularly for deep deposits. Therefore other techniques, such as solution mining, may need to be employed. The costs involved in solution mining operations and the problems encountered therein may have heretofore made such solution mining techniques infeasible, but with the continued depletion of present easily accessible mineral deposits, such may be the only practical approach in the future to supply needed minerals. It is because of a belief that there will exist a pressing future need for efficient and economical solution mining techniques that the present invention in an improved method for solution mining was developed.

Prior Art

The process of technique for mining of in situ mineral deposits utilizing a leaching solution has long been known and in common practice, in some cases, constitutes a first step in a refining process for such minerals and an example of such a process is shown in U.S. Pat. No. 3,917,345. Further, it is well known to use solution recovery of such things as hydrocarbons from deposits of oil, gas sands, and oil shale, or even a played out oil well, with an appropriate solution for such purposes being super heated water and steam. One such process is shown in U.S. Pat. No. 3,501,201.

Obviously, solution processes for recovery of minerals have often involved pumping of a leaching solution through a deposit and then retrieving that solution, pregnant with minerals, for processing. Examples of some such processes are shown in U.S. Pat. Nos. 2,563,623; 3,967,853; and 4,027,731.

The techniques and processes described in U.S. Pat. No. 3,501,201 for dissolving of hydrocarbons have also been utilized for in situ mining of minerals, with examples of apparatus and processes for such in situ mining also shown in U.S. Pat. Nos. 3,490,811; 3,498,674; 3,574,402; and 3,910,636. An example of a solution mining for a brine field is shown in U.S. Pat. No. 3,012,764.

That minerals can be leached from subsurface deposits is shown in the above and within U.S. Pat. Nos. 2,850,270; 2,954,218; 3,278,233; 3,682,246; 3,810,510; and 3,841,705, which patents, like the present invention, all involve a plurality of well bores sunk into deposits and employ various leaching techniques for withdrawal of minerals or hydrocarbons therefrom. No former processes prior to the present process, however, has provided for an effective breaking up of the in situ formation and therefore subsequent leaching with chemicals has not been efficient.

Recovery techniques having steps in common to those of the present invention are shown for hydrocarbons in the above cited U.S. Pat. No. 3,501,201 are in U.S. Pat. Nos. 3,278,233 and 3,841,705 for minerals. U.S. Pat. No. 3,501,201 also shows a typical fracturing of well bores to increase the flow therethrough or therebetween to increase the size of a leached zone.

The present invention, while, like certain of the above cited prior art patents, it also utilizes a multiplicity of well bores and involves fracturing those well bores, and utilizes a leaching solution to remove the minerals, is distinct in that it involves a programmed placement of well bores to obtain maximum recovery of minerals sweeping out of an area between parallel well bore fractures and employs a disintegrating solution in the fracture process to dissolve the binding materials in an impermeable or nearly impermeable deposit to provide for a free flow of a leaching solution throughout the deposit. Such programmed placement preferably utilizes a process like that described in U.S. Pat. No. 4,044,828, issued to the present inventors as joint inventors thereof, whereby by first locating the fracture direction of a well bore it is then possible to optimumly locate production well bores alongside with fractures developed in those production well bores, then predictably to run or extend parallel to the fracture or fractures induced in the first well bore. Thereby, a maximum recoverable area of the deposit is obtained between said fractures making for more efficient solution mining processes.

A utilization of a leaching solution pumped between well bores is not new, nor is the controlled fracturing of well bores to provide for increasing the recovery area between the well bores. However, within the knowledge of the inventors, the use of a disintegrating solution in the fracturing of the well bore has not been employed for both breaking up an impermeable or nearly impermeable material and for dissolving binding materials in the deposit to provide for a free flow of leaching solution throughout the deposit as taught by the present invention. The present invention is therefore believed to be both novel and unique and to constitute a significant improvement over past processes and techniques for solution mining.

SUMMARY OF THE INVENTION

It is therefore a general object of the present invention to provide an improved method for solution mining of an impermeable or nearly impermeable in situ mineral deposit.

It is an additional object of the present invention to provide an improved method for in situ minerals mining of impermeable of nearly impermeable deposits involving well bores drilled into a deep mineral deposit for passing a leaching solution therebetween to include locating the direction of a fracture induced into a first well bore using a disintegrating solution as a fracture medium for appropriate location of one or more other well bores such that, when said other well bores are also fractured, also utilizing a disintegrating solution as the fracture medium, their major fracture lines will run alongside that of the first well bore fracture and the disintegrating solution will appropriately dissolve the binder materials in the deposit between the fractures to provide for a thorough breaking up of the deposit therebetween encouraging a flow of the leaching solution therethrough.

It is an additional object of the present invention to provide an improved method for in situ minerals mining that utilizes, for appropriate location of a first or injector well bore and one or more production well bores, a process developed by the present inventors in concert with other persons whereby surface stress changes are sensed during fracture of a first well bore for determining the direction of that fracture, which fracture direction determination is used to locate for drilling the production well bores.

It is an additional object of the present invention to determine, by analysis of the mineral deposit characteristics an optimum spacing between the first well bore and production well bores.

It is an additional object of the present invention to open, with a minimum outlay of resources for drilling and fracturing well bores in a mineral deposit, a maximum area between well bores to be broken up and dissolved from within that deposit for removal and further processing.

In accordance with the above objects, the steps involved in practicing the method of the present invention for in situ mining of an impermeable or nearly impermeable mineral deposit include a determination of the depth and area of an in situ minerals deposit appropriate for solution mining, which determination can be made by standard core drilling methods, or the like. Thereafter, a first or injector well bore is drilled into the deposit, preferably centrally therein, and is packed off appropriately for fracturing. Prior to that fracturing and in accordance with the teachings of the U.S. Pat. No. 4,044,828, or a like technique, sensors are located at the ground surface appropriately near and around the first well bore for determing, at the time of fracture thereof, the direction a fracture or fractures extending outwardly from that injector well bore. The injector well bore is then fractured utilizing a disintegrating solution such as hydrogen peroxide as the pressure medium, said sensors measuring stress changes at the surface occurring during that fracturing and thereafter the collected data is analyzed to determine the fracture direction either/or both vertically and horizontally. From that determination, and taking into account the composition and characteristics of the deposit, and the like, subsequent production well bores are located alongside and spaced appropriately apart from the injector well bore, which production well bores are then fractured utilizing the disintegrating solution as the pressure medium, those fractures thereby extending alongside the first fracture with the disintegrating solution dissolving or breaking up the binding materials throughout the aggregate materials in the deposit between the fractures.

Proppants, such as sand, or the like, are preferably passed into the production well bore fractures during fracture thereof. Whereafter such disintegrating solution is removed and a leaching solution or fluid is introduced through the injector well bore. The leaching solution passes through the broken up deposit between the injector and production well bores, dissolving minerals in that passage, and is then removed for further processing by conventional refining methods.

Should a proper or desired flow not initially exist between the injector and production well bores and their fractures, then the injector well bore can be arranged to retrieve the leaching solution practicing solution mining around the injector well bore, thereby reducing the distance between the injector and production well bores and their fractures until a flow can be induced therebetween, whereafter the leaching solution, after passage through the deposit, can be withdrawn from the production well bores.

THE DRAWINGS

Figure 3:
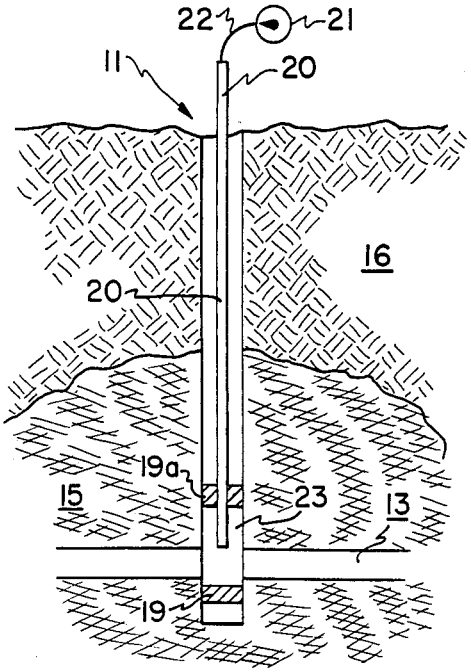
FIG. 3, is a sectional view of a first or injector well bore drilled into an in situ mineral deposit, the well bore shown as having been fractured between a packed off area therein.
Figure 5:
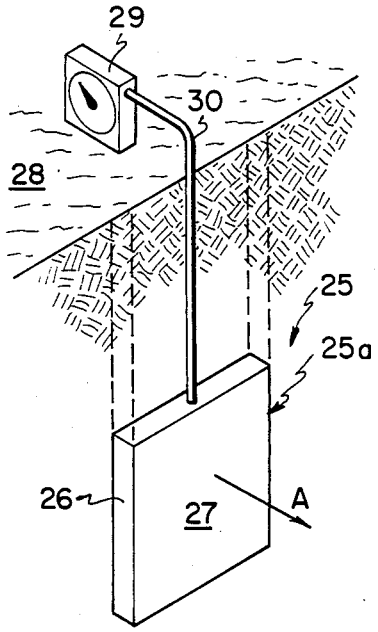
Figure 4:
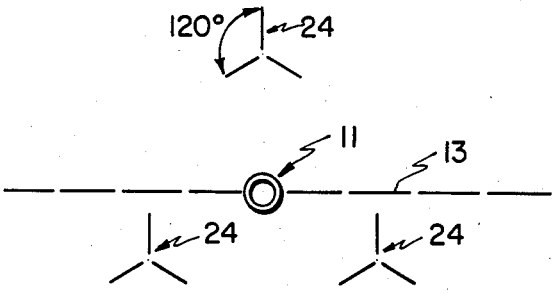

FIG. 4, shows an arrangement of pressure sensing devices surrounding the well bore of FIG. 3, for sensing during fracture, surface stress changes, from which stress change measurements the fracture direction can be located; and FIG. 5, shows an enlarged view of one of the sensors shown in FIG. 4, that is arranged in the ground proximate to the surface and includes a meter connected thereto for sensing stress changes at the time of well bore fracture.

DETAILED DESCRIPTION

Figure 1:
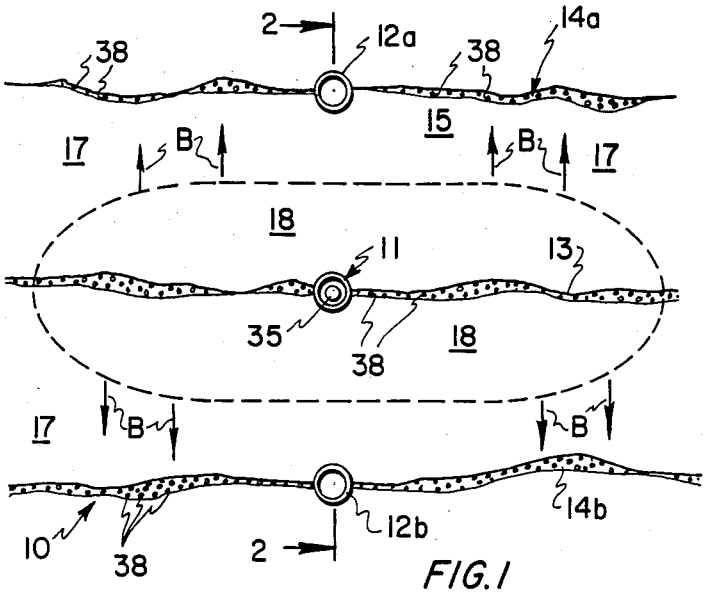
FIG. 1, is a top plan schematic of a plurality of well bores illustrating a practicing of the method of the present invention showing fractures extending from each well bore, said fractures extending essentially parallel to one another and spaced appropriately apart.

Referring now to the drawings:

In situ solution mining of minerals from a subsurface deposit traditionally requires the injection of some leaching solution into the deposit to dissolve metal values, which leaching solution is then recovered, pregnant with minerals from the deposit, and is then further refined. The present invention provides an improved in situ mining process that includes multiple well bores that are uniquely located such that the direction of fractures induced therein, as illustrated by FIG. 1, will be parallel to one another, providing an area of minerals therebetween to be swept out or removed. To appropriately locate injector and production well bores, hereinafter referred to as injector and production wells 11, **12*a* and 12*b*, as shown in FIG. 1, such that fractures 13, 14*a* and 14*b*** induced therein will extend parallel to each other, the present invention preferably utilizes the present inventor's fracture location process as taught in U.S. Pat. No. 4,044,828 as will be explained in detail later herein.

Practicing the method of the present invention requires locating a first or injector well 11, shown in FIG. 1, accordance with the geology of the mineral deposit. During fracture thereof, a determination of the direction, both vertical and horizontal, of at least a principal fracture 13 is made and therefrom at least one but preferably two production well bores **12*a* and 12*b* are located on opposite sides and such that fractures appropriately induced therein at 14*a* and 14*b* can be assumed to extend essentially parallel to and spaced apart from fracture 13 of the injector well bore 11. The areas between the fractures 13, 14*a* and 14*b* provide the area of in situ minerals to be recovered from between the injector and production wells 11, 12*a* and 12*b*. By appropriately spacing apart the injector and production wells, the area between fractures will provide for an optimum mineral recovery from between a minimum of well bores. The determination of the spacing for production wells 12***a* and 12*b* will be explained later herein and relates to the characteristics of the mineral deposit to be mined. The fractures 13, 14*a* and 14*b* from each well 11, 12*a* and 12*b*, are shown, as extending therefrom essentially parallel to one another. The area of the mineral deposit recoverable is therefore that area 17 between the fractures 14*a* and 14*b*. While an injector and two production wells are preferred it should be understood that a minimum recovery configuration for practicing the method of the present invention, would be an injector and a single production well.

Figure 2:
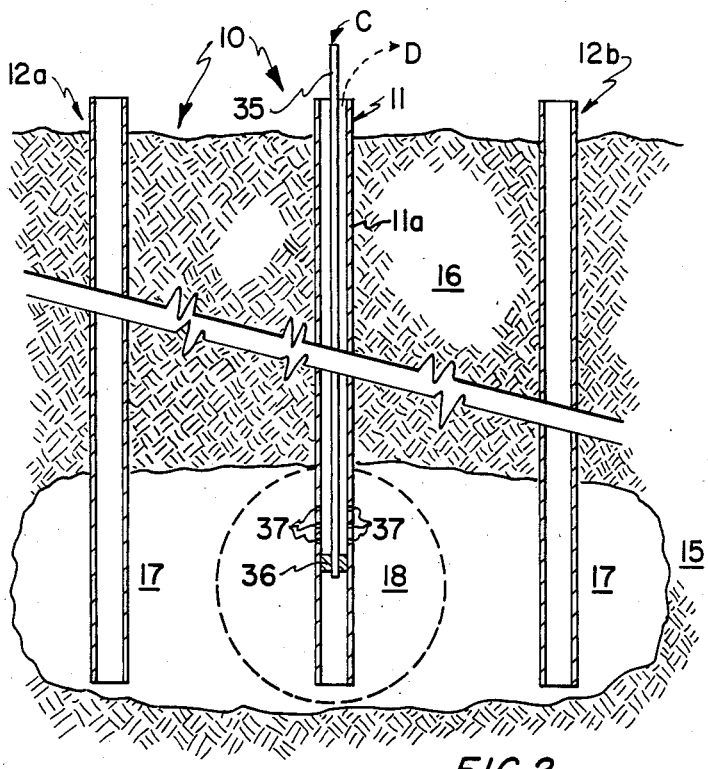
FIG. 2, is a profile sectional view of the well bores of FIG. 1 taken along the line 2—2, showing, with broken and solid lines, areas of minerals broken up and leached from around and between said well bores.

In FIG. 2, is shown a profile sectional view of an embodiment of injector and production wells of FIG. 1, with the injector well 11 shown extending into a mineral deposit 15, with areas of rock strata 16 shown thereabove. On either side of injector well 11 are shown production wells 12*a* and 12*b* that also extend into the mineral deposit 15 with a solid line encircling the area 17 therebetween that identified part of the deposit that is recoverable practicing the method of the present invention. In such practice, the area 17 is first broken up during the fracturing of the wells 11, 12*a* and 12*b*, that utilizes a disintegrating solution as the pressure medium to also dissolve binder materials in and throughout the area 17 of the deposit of impermeable or nearly impermeable minerals. The dissolving solution promotes a free flow of leaching solution throughout area 17 to provide for an efficient and essentially complete dissolving of that particular portion of mineral deposit 15, as will be explained in detail later herein.

Referring to FIG. 3, therein is shown the injector well 11 as a well bore prior to fracture thereof. The bore is formed or drilled through rock strata 16 into the mineral deposit 15 and, in anticipation of fracturing, the well bore has been sealed or plugged at 19 and 19*a* between a depth whereat it is determined that a fracture should be located, which plugs should be understood to be constructed of a material that will not react to the disintegrating solution used as the pressure medium in the fracture process. Plug 19*a*, as shown in FIG. 3, has a tube, hose, pipe, or the like 20, fitted therethrough that should be understood to be sealed in that plug. Pipe 20 is intended to receive a disintegrating fluid under pressure from a pressure source 21 through a hose, tube or the like 22 to fracture the well bore and to dissolve binding materials of the aggregate deposit to establish a multitude of flow paths throughout area 17. Prior to the injection of that disintegrating fluid under pressure into a space 23 between the plugs 19 and 19*a*, sensing devices 25, like the device shown in FIG. 5, are arranged around injector well bore in a pattern 24, as shown in FIG. 4. So arranged, when disintegrating fluid under pressure is pumped, as described, into space 23 it will induce fracture 13 therein. That fracturing will, in turn, cause stresses to be transmitted through the ground to the surface that are picked up by the pattern of sensing devices 24. The procedure, as taught in the aforesaid U.S. Pat. No. 4,044,828, involves a method for direct measurement of the orientation of hydraulic fractures, and employs individual sensing devices 25, as shown in FIG. 5. The sensing device 25 includes a narrow shell housing 25*a* that contains a pressurized working fluid therein. The narrow shell housing 25*a* is positioned in the ground in pattern 24 of FIG. 4, with each sensing device 25 spaced at approximately a one hundred twenty degree (120°) arc from the others, with a shell narrow side 26 of each parallel and proximate to a common pattern center. So arranged, a shell wide face 27 will be perpendicular to the ground surface 26 and stress changes traveling through the ground, as at well fracture, will move the fluid therein as illustrated by arrow A. A pressure gauge 29 is preferably connected through a tube 30 to the sensing device 25 to measure changes in fluid pressure within the interior during fluid movement. The pressure changes indicated on pressure guage 29 are recorded and used in conjunction with the pressure changes measured by the other sensing devices 25 in pattern 24 to compute the direction, in both vertical and horizontal components, of a fracture formed in the injector well 11. The fracture is located using the procedures outlined in detail in our aforementioned U.S. Pat. No. 4,044,828, that assumes that the direction of such sensed pressure changes is normal to the shell wide face 27 as shown by arrow A, in FIG. 5.

Thereafter, from the above determined location of fracture 14, one or more production wells 12*a* and 12*b* can be laid out alongside and normal to the injector well 11. Therefrom, it has been found in practice, that when production wells are located appropriately to one another and are fractured, also using a disintegrating solution, at approximately the same depth in the deposit 15, the major fracture lines thereof will be essentially parallel to one another and to fracture 13. During and after fracture of production wells 12*a* and 12*b* the disintegrating solution in injector well 11 and fracture 13 therefrom can be maintained in a pressurized state or can be later repressurized to encourage flow thereof to the production wells and fractures eminating therefrom.

Utilizing the above technique, an optimum arrangement of production wells 12*a* and 12*b* can be laid out on a straight line through injector well 11, the fractures therefrom extending normal to that line on either side thereof. The spacing or distance between the wells 11, 12*a* and 12*b* is preferably arrived at by an analysis of the makeup of the particular mineral deposit 15, the pressure required to create or cause the fracture of the wells, along with an analysis of the permeability of the particular mineral deposit. These factors are identified as follows:

s=spacing in ft.
k=permeability of the deposit in darcys
$\mu$=viscosity of the leaching fluid in centipoise
A=fracture area in ft.$^2$
q=flow rate of the leaching fluid in barrels/day
$\Delta\rho$=the pressure drop between the injector and production wells in psi.

It has been determined that the formula for computing spacing of at least one production well from an injector well 11 would be:

$$s=1.127(\kappa/\mu)\ (A/q)\Delta\rho.$$

Therefore, by substituting estimated and calculated values for the deposit into the above formula an estimate of desirable well spacing can be made.

The method of the present invention is preferably practiced on impermeable or nearly impermeable deposits of aggregate materials usually found well below the ground surface and therefore prior to introduction of a leaching solution therein for removal of appropriate minerals, it is required that deposits around and between injector and procutions wells, or as appropriate, around the injector well, be broken up. This breaking up of the deposit is accomplished in the present method by utilization of a disintegrating solution, preferably a hydrogen peroxide solution of up to a twenty percent (20%) concentration, as the pressure medium in the fracturing of both the injection and production wells. In the fracture process the disintegrating solution, additional to fracturing the deposit 15, is also forced under pressure into the deposit to react with binding materials between the hard rock of the aggregate deposit opening a multitude of flow paths therethrough around and between the injector and production wells.

Thereafter, with the deposit area 17 broken up and the disintegrating solution removed, a leaching solution, preferably under pressure, is injected through the injector well 11, into area 17. With a pressure differential in existence between the injector well and production wells 12*a* and 12*b*, that leaching solution will travel, as shown by arrows B in FIG. 1, from injector well 11, to the production wells 12*a* and 12*b*, dissolving appropriate minerals from the deposit in that passage and is then withdrawn through the production wells. Thereafter, the leaching solution, pregnant with minerals, can be further refined to separate the minerals therefrom. To encourage flow between the wells and their fractures, proppants 38, as shown in FIG. 1, that preferably consist of sand, or the like, can be forced into said fractures 13, 14*a*, and 14*b*, at the time or after the wells are fractured, to maintain those fractures in an open attitude as the disintegrating and leaching solutions are working therein.

In summary, based upon the above, the basic steps in practicing the method of the present invention, therefore include a locating of a subsurface mineral deposit suitable for in situ mining of impermeable or nearly impermeable aggregate materials; forming an injector well bore into that mineral deposit and packing off that well bore appropriately to fracture the well bore using a disintegrating solution as the pressure medium; prior to undertaking fracturing, locating at or near ground level appropriate to the well bore, one or more sensing devices capable of accurately recording pressure changes indicative of surface stress changes that occur at the fracture and are transmitted through the ground to the surface when the disintegrating solution therein is appropriately pressurized, for providing data that can be mathematically interpreted to locate the direction of a major fracture induced in the injection well bore; the well bore is then fractured, by introduction of a disintegrating solution, such as hydrogen peroxide up to a twenty percent (20%) concentration, under pressure, which solution can, as appropriate, include proppants, such as sand or the like, for maintaining the induced fracture in an open attitude; from the pressure change data collected at surface sensing devices during fracturing, determining the direction of that fracture and thereafter locating at least one production well alongside the injector well bore that is normal to the line of the major fracture therefrom; spacing appropriately that production well bore from the injector well based on an analysis of the characteristics of the deposit; forming the production well and fracturing it utilizing a disintegrating solution such as hydrogen peroxide up to a concentration of twenty percent (20%) as the pressure medium, during which fracturing proppants, such as sand or the like, can be included in the solution to pass into the production well fracture for holding open that fracture; maintaining the disintegrating solution in the injector and/or production wells to disintegrate binding materials from around the hard rock of the aggregate material, opening up a multitude of flow paths through the deposit between and around the injector and production wells and withdrawing that solution; introducing a leaching solution, under pressure, into the injector well to flow between the injector and production wells and the fractures emanating therefrom that flow being across and through the multiple paths formed by the disintegrating solution through the mineral deposit, leaching and dissolving minerals from that deposit in that passage; and drawing off that leaching solution pregnant with minerals for further processing and refining.

Unique from former solution mining processes, the method of the present invention as outlined by the steps hereinabove, by utilizing a disintegrating solution as the pressure medium provides for opening of a multitude of flow passages through area 17 of the deposit 15, enabling essentially a complete removal of minerals therefrom in the leaching step. However, should for any reason the disintegrating solution fail to provide in a timely manner, for an opening of area 17 between the injection and production wells, as an optional step in practicing the method of the present invention, the injector well 11, as shown in FIG. 2, can be provided with an injector tube or pipe 35 that extends from the ground surface and through a plug 36 arranged in the base of well casing 11*a*. Through that pipe 35, as shown by arrow C, other higher concentrations of disintegrating solutions than that used in the fracture and leaching solutions can be injected into and withdrawn from the mineral deposit 15, with the disintegrating solution, of course, being injected first and removed before the leaching solution is passed therein, to dissolve minerals and is then withdrawn, pregnant with minerals. The disintegrating and leaching solutions could, of course, be both introduced into and withdrawn from the deposit through pipe 35, but if it is desired to maintain a pressurized flow of such solution, that solution can be withdrawn through holes 36 formed in the injector well casing 11*a*, as shown in FIG. 2, passing through the injector well to the surface, as shown by broken arrow D. So arranged by the operation of the disintegrating solution, the deposit around the injector well casing 11*a* is broken up, allowing the leaching solution to be fully removed therefrom, carving section 18, shown in broken lines in FIG. 2. As section 18 is enlarged, the distance between the mineral deposit 15 between the injector and production wells would, of course, be reduced and ultimately a flow from the injector well 11 to production wells 12*a* and 12*b* can be established. Thereafter, the area between the injector and production wells and their fractures, shown at 17 in FIG. 2, can be removed, as described, for further refining.

While the above described steps are those preferred in practicing the improved solution mining process of the present invention on aggregate deposits of little or no permeability, it is to be understood that modifications to the described steps or substitution of apparatus for apparatus described herein, such as a utilization of different sensing devices than those shown to sense surface stress changes, could be made, without departing grom the scope or spirit of the disclosure coming within the following claims, which claims we regard as our invention.

We claim:

1. An improved method for in situ mining of a subsurface aggregate mineral deposit of low permeability comprising the steps of:

locating a subsurface aggregate mineral deposit suitable for in situ mining;

forming an injector well bore into said mineral deposit;

packing off, at a desired depth within said mineral deposit, a portion of said injector well bore where fracture will be undertaken;

positioning stress sensing means appropriate to said injector well bore, such stress sensing means for sensing pressure changes that result when said injector well bore is fractured for resolution into principal components for mathematically determining the direction of a major fracture induced in said injector well bore;

fracturing said mineral deposit around said injector well bore by introducing a disintegrating solution under pressure as the pressure medium within the packed off area in said injector well bore, that also dissolves the aggregate bonding to open the deposit along the fracture;

determining from the surface pressure changes sensed by said stress sensing means the direction of the major fracture emanating from said injector well bore;

positioning at least one production well bore alongside said injector well bore such that a line through said production and injector well bores will be essentially normal to said major fracture, said production well bore being spaced appropriately from said injector well bore such that a flow of solution can be established between said well bores;

packing off and fracturing, utilizing a disintegrating solution under pressure as the pressure medium, said production well bore at essentially the same depth as said injector well bore fracture, which disintegrating solution also dissolves the aggregate bonding to open the deposit along the fracture;

after withdrawal of the disintegrating solution, introducing a leaching solution into said mineral deposit to dissolve minerals therefrom, and withdrawing that solution pregnant with dissolved minerals therefrom for further refining; and by the steps set out above, locating the direction of major fracture emanating from each injector well bore formed into said mineral deposit for placement of production wells to practice said solution mining process.

2. An improved method for in situ mining of a subsurface aggregate mineral deposit of low permeability as defined in claim 1, wherein the disintegrating solution used as a pressure medium is a hydrogen peroxide in a concentration of up to twenty percent (20%).

3. An improved method for in situ mining of a subsurface aggregate mineral deposit of low permeability as defined in claim 1, wherein the step of spacing appropriately said production well bore from said injector well bore is determined from the formula, $$S = -1.127(\kappa/\mu)(A/q)\Delta\rho$$

where;

S=spacing in feet;

$\kappa$=permeability of the deposit in darcys;

$\mu$=viscosity of the leaching fluid in centipoise;

A=fracture area in ft.$^2$;

q=flow rate of the leaching fluid in barrels/day; and $\Delta\rho$=the pressure drop between the injector and production wells in lbs. per square inch.

4. An improved method for in situ mining of a subsurface aggregate mineral deposit of low permeability as defined in claim 1, further including the step of introducing during fracturing proppants into said production well bores.

5. An improved method for in situ mining of a subsurface aggregate mineral deposit of low permeability as defined in claim 1, wherein the leaching solution is passed, under pressure, into the injector well bore to flow into the fracture emanating therefrom and through the mineral deposit into the production well bore and fracture emanating therefrom from which production well bore said solution is withdrawn.

6. An improved method for in situ mining of a subsurface aggregate mineral deposit of low permeability as defined in claim 1, further including the steps of after fracture and casing thereof, plugging appropriately the injector well bore with a plug that includes an injector pipe fitted therethrough;

passing a leaching solution through said injector pipe into the broken up mineral deposit dissolving appropriate minerals therefrom; and withdrawing said leaching solution pregnant with dissolved minerals from said mineral deposit through said injector pipe for further processing.

7. An improved method for in situ mining of a subsurface aggregate mineral deposit of low permeability as defined in claim 6, further including the steps of, alternating introduction and withdrawal of disintegrating and leaching solutions through the injector pipe.

8. An improved method for in situ mining of a subsurface aggregate mineral deposit of low permeability as defined in claim 6, further including the steps of forming holes through the casing in the injector hole above the plug; and introducing the leaching solution under pressure through the injector pipe and withdrawing the leaching solution pregnant with minerals through the holes formed in the casing.

* * * * *